US007448177B2

(12) United States Patent
McClintick

(10) Patent No.: US 7,448,177 B2
(45) Date of Patent: Nov. 11, 2008

(54) SLATE ROOF AND METHOD FOR INSTALLATION

(75) Inventor: Edward Lee McClintick, San Antonio, TX (US)

(73) Assignee: Elk Premium Building Products, Inc., Dallas, TX (US)

( * ) Notice: Subject to any disclaimer, the term of this patent is extended or adjusted under 35 U.S.C. 154(b) by 455 days.

(21) Appl. No.: 11/224,537

(22) Filed: Sep. 12, 2005

(65) Prior Publication Data

US 2006/0059832 A1 Mar. 23, 2006

Related U.S. Application Data

(60) Provisional application No. 60/609,391, filed on Sep. 13, 2004.

(51) Int. Cl.
*E04D 1/34* (2006.01)
*E04B 1/00* (2006.01)

(52) U.S. Cl. ..... 52/551; 52/748.1

(58) Field of Classification Search ..... 52/543, 52/547, 548, 550, 549, 551, 506.05, 506.01, 52/747.11, 747.1, 748.1; 22/26.2, 45, 89.01, 22/106.01; 248/339; 211/26.2, 45, 89.01, 211/106.01
See application file for complete search history.

(56) References Cited

U.S. PATENT DOCUMENTS

| | | | | | |
|---|---|---|---|---|---|
| 623,988 | A | * | 5/1899 | Contant | 52/26 |
| 1,358,863 | A | | 11/1920 | McConnell | |
| 1,399,315 | A | * | 12/1921 | Ocampo | 52/548 |
| 1,447,290 | A | | 3/1923 | Fischer | |
| 1,582,281 | A | * | 4/1926 | Boyle et al. | 52/546 |
| 2,097,845 | A | | 11/1937 | Snow | |
| 2,114,362 | A | | 4/1938 | Tashjian | |
| 2,205,307 | A | | 6/1940 | Parsons | |
| RE24,246 | E | | 12/1956 | Fink et al. | |
| 3,252,257 | A | | 5/1966 | Price et al. | |
| 3,292,334 | A | | 12/1966 | Craig | |
| 3,624,975 | A | | 12/1971 | Morgan et al. | |
| 3,746,378 | A | | 7/1973 | Meyer | |
| 3,803,792 | A | | 4/1974 | Fulton | |
| 3,885,075 | A | | 5/1975 | Ferrante | |
| 3,894,376 | A | | 7/1975 | Shearer | |

(Continued)

FOREIGN PATENT DOCUMENTS

| | | |
|---|---|---|
| GB | 283027 | 1/1928 |

(Continued)

*Primary Examiner*—Brian Glessner
*Assistant Examiner*—Adriana Figueroa
(74) *Attorney, Agent, or Firm*—Baker & McKenzie LLP

(57) ABSTRACT

A roof having slate attached by battens and hangers. The hangers have a short member and a tong member. The long member has a hook on one end and the remaining end is adjacent to a first outward extending arm. The first outward extending arm is adjacent to a central connecting member. The central connecting member is adjacent a second outward extending arm. The second outward extending arm is adjacent to the short member. The first and second outward extending arms are removeably secured to the battens. The slate roof is installed by positioning and attaching the battens to a roof deck. The hangers are then secured to the battens by squeezing the short member and long member together and inserting the first and second outward extending arms into the adjacent hanger holders on the batten.

17 Claims, 12 Drawing Sheets

U.S. PATENT DOCUMENTS

| | | | | | |
|---|---|---|---|---|---|
| 4,078,349 | A | | 3/1978 | Gantner | |
| 4,489,532 | A | * | 12/1984 | Ellis et al. | 52/748.1 |
| 4,610,902 | A | | 9/1986 | Eastman et al. | |
| 4,671,036 | A | | 6/1987 | Sullivan | |
| 4,680,909 | A | | 7/1987 | Stewart | |
| 4,694,716 | A | | 9/1987 | Sakamoto | |
| 5,086,552 | A | | 2/1992 | Moore | |
| 5,228,264 | A | | 7/1993 | Whitman | |
| 5,258,222 | A | | 11/1993 | Crivelli | |
| 5,457,924 | A | | 10/1995 | Fujii et al. | |
| 5,527,409 | A | | 6/1996 | Lanphier | |
| 5,531,334 | A | * | 7/1996 | Forby | 211/119 |
| 5,570,553 | A | | 11/1996 | Balkins | |
| 5,577,360 | A | * | 11/1996 | Gibbs | 52/518 |
| 5,615,523 | A | | 4/1997 | Wells et al. | |
| 5,642,596 | A | | 7/1997 | Waddington | |
| 5,791,112 | A | | 8/1998 | Plum | |
| 6,052,961 | A | * | 4/2000 | Gibbs | 52/518 |
| 6,237,288 | B1 | | 5/2001 | Jenkins et al. | |
| 6,586,353 | B1 | | 7/2003 | Kiik et al. | |
| 6,619,006 | B1 | | 9/2003 | Shirota | |
| 6,673,432 | B2 | | 1/2004 | Kiik et al. | |
| 6,708,456 | B2 | | 3/2004 | Kiik et al. | |
| 7,132,143 | B2 | * | 11/2006 | Zanchetta et al. | 428/40.1 |
| 2004/0148898 | A1 | | 8/2004 | Hick | |
| 2004/0244156 | A1 | | 12/2004 | Jackson, Jr. et al. | |

FOREIGN PATENT DOCUMENTS

| | | |
|---|---|---|
| GB | 392118 | 5/1933 |
| GB | 640776 | 7/1950 |
| GB | 1438485 | 6/1976 |
| GB | 2131060 | 6/1984 |
| JP | 2204556 | 8/1990 |
| JP | 6322898 | 11/1994 |

* cited by examiner

SLATE ROOF AND METHOD FOR INSTALLATION

This application claims priority to U.S. Provisional Application Ser. No. 60/609,391 filed Sep. 13, 2004.

BACKGROUND OF THE INVENTION

1. Field of the Invention

Applicant's invention relates to a slate roof and method for installation.

2. Background Information

Slate is one of the finest roofing materials available and has several advantages over asphalt shingle roofs. State roofing is fireproof, resists hail damage, and often has a service life of 100 years or more. However, slate is a rigid natural stone product which unfortunately can be damaged by stress. Stress can be introduced into slate in several ways, but the most common cause of stress to slate is nails used to attach the slate to the roof deck. With nail installation, the nails need to be fastened so the state hangs on the nail. If the nail is inserted too tightly, the nail will pinch the slate. On the other hand if the nail is not inserted deep enough, the overlapping piece of slate may crack from the hidden pressure point. Environmental effects on the wood decking and nails may also contribute to the stress. Environmental changes such as swings in temperature and humidity can cause the decking to expand and contract. If the nails are in a bind in this situation, the slate can crack or fall.

The objective of the present invention was to design a slate roof installation system and method for installation that does not use nails to mount the slate on the roof. Some attempts in the prior art to solve this problem have used individual Z hangers which makes installation tedious. The present invention allows a plurality of hangers to be installed at one time. Since damage can also be caused during roof construction, the installation of a plurality of hangers at one time allows the slate to be installed from the top down. In addition, the nature of the hangers allows the roof to be easily repaired without tools. The metal used in the hangers can also be more durable since the present hangers do not need to be formed into a Z pattern. The hangers of the present invention are also spring tempered which helps them spring against the roof deck. This also permits the hangers to provide superior wind uplift protection.

While this application makes specific reference to slate and slate installation, the invention and techniques provided herein apply to tile and tile installation as well.

SUMMARY OF THE INVENTION

The preferred embodiment of the present invention includes a roof having state attached by battens and hangers. The hangers have a short member and a long member. The long member has a hook on one end and the remaining end is adjacent to a first outward extending arm. The first outward extending arm is adjacent to a central connecting member. The central connecting member is adjacent a second outward extending arm. The second outward extending arm is adjacent to the short member. The first and second outward extending arms are removeably secured to the battens. The roof further includes state liner positioned above the hangers as well as underlayment positioned below the battens. Self-adhering membrane is placed below the underlayment. In addition, the roof includes valley metal, gable/rake edge metal and drip edge metal positioned on the roof deck. The slate roof is installed by positioning and attaching the battens to a roof deck. The hangers are then secured to the battens by squeezing the short member and long member together and inserting the first and second outward extending arms into adjacent hanger holders on the batten. The state liner is positioned above the hangers before placing down the slate. In addition, underlayment is placed below the battens and self-adhering membrane is placed below the underlayment.

DETAILED DESCRIPTION OF THE PREFERRED EMBODIMENT

Figure 1:
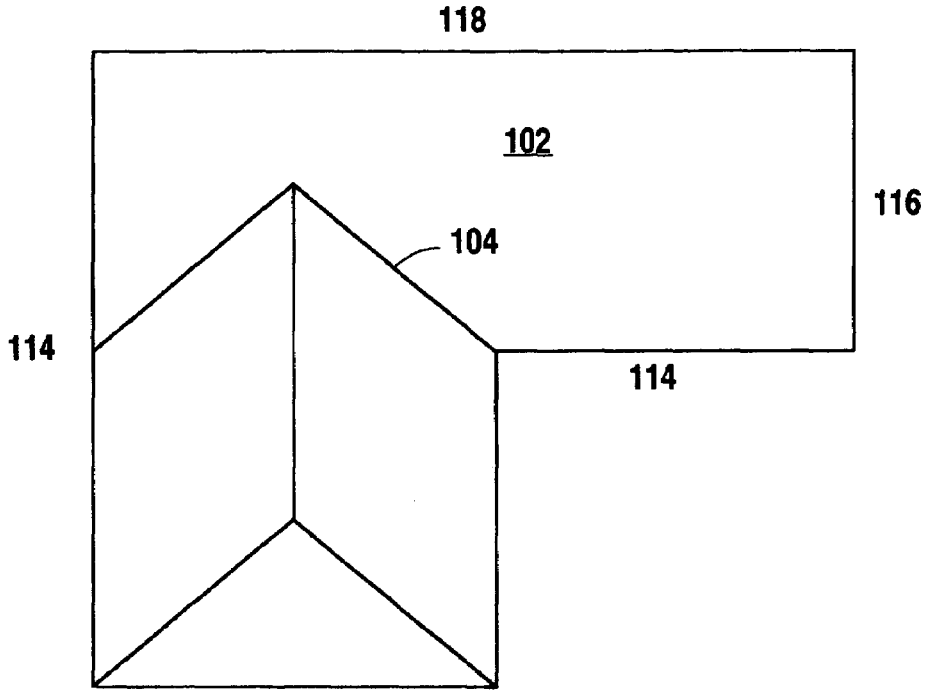
FIG. 1 is a top view of a roof deck.

In FIG. 1 a top view of a roof deck 102 is shown. In the present methodology, the initial step is to inspect and prepare the roof deck 102. The roof deck 102 has a valley 104, eave 114, gable/rake 116 and ridge 118. In this roof deck 102 inspection step, the existing roof sheathing is inspected for structural integrity. The roof deck 102 should be preferably minimum 15/32 inch plywood or code approved oriented strand board (OSB). All roof deck 102 nails should be driven flush with the roof deck 102. The roof deck 102 should be inspected for protrusions which may damage felt underlayment 110 (See FIG. 3).

Figure 2:
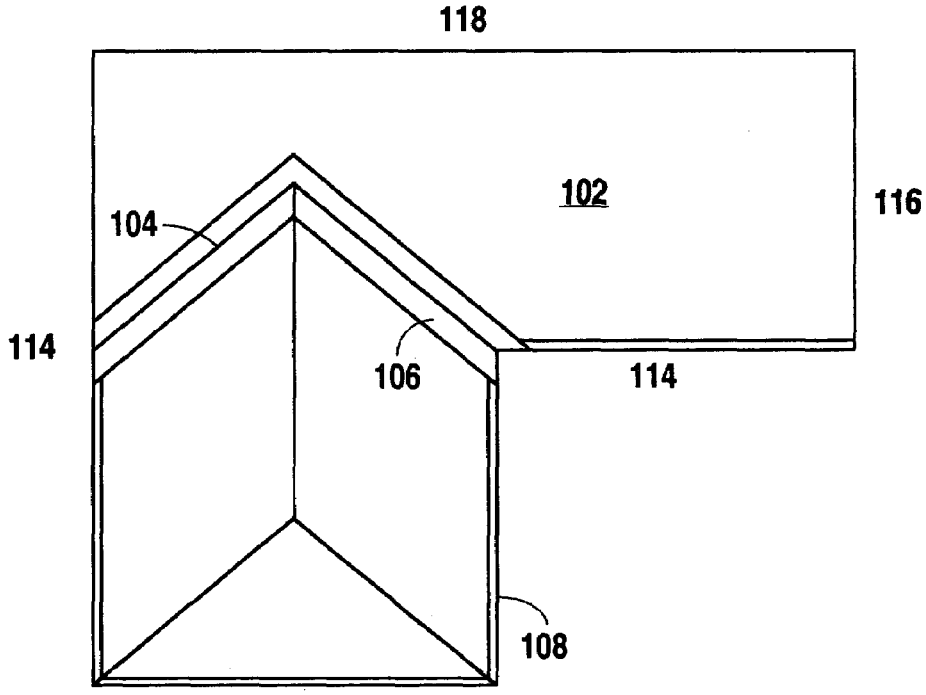
FIG. 2 is a top view of the roof deck illustrating valley preparation and drip edge installation.

FIG. 2 is a top view of the roof deck 102 illustrating valley 104 preparation and drip edge 108 installation. In this step of the present methodology, the user installs peel and stick membrane 106 in the valleys 104 while overlapping membrane 106 seams a preferred minimum of six inches. The membrane 106 used is preferably a self-adhering poly(styrene-butadiene-styrene) (SBS) type. The membrane 106 used in the preferred embodiment was Tarco™ Leak Barrier Ice and Water Armor; however, any equivalent membrane can be utilized. The membrane 106 is preferably 36 inches wide. All drip edge 108 metals are then installed. The drip edge 108 is preferably D style No. 26 gauge galvanized or 16 ounce copper metal. On new construction, if the exterior fascia board has not been painted, the drip edge 108 may be delayed and installed after the underlayment 110 (See FIG. 3) is installed. The underlayment 110 (See FIG. 3) must extend over the drip edge 108 metal.

Figure 3:
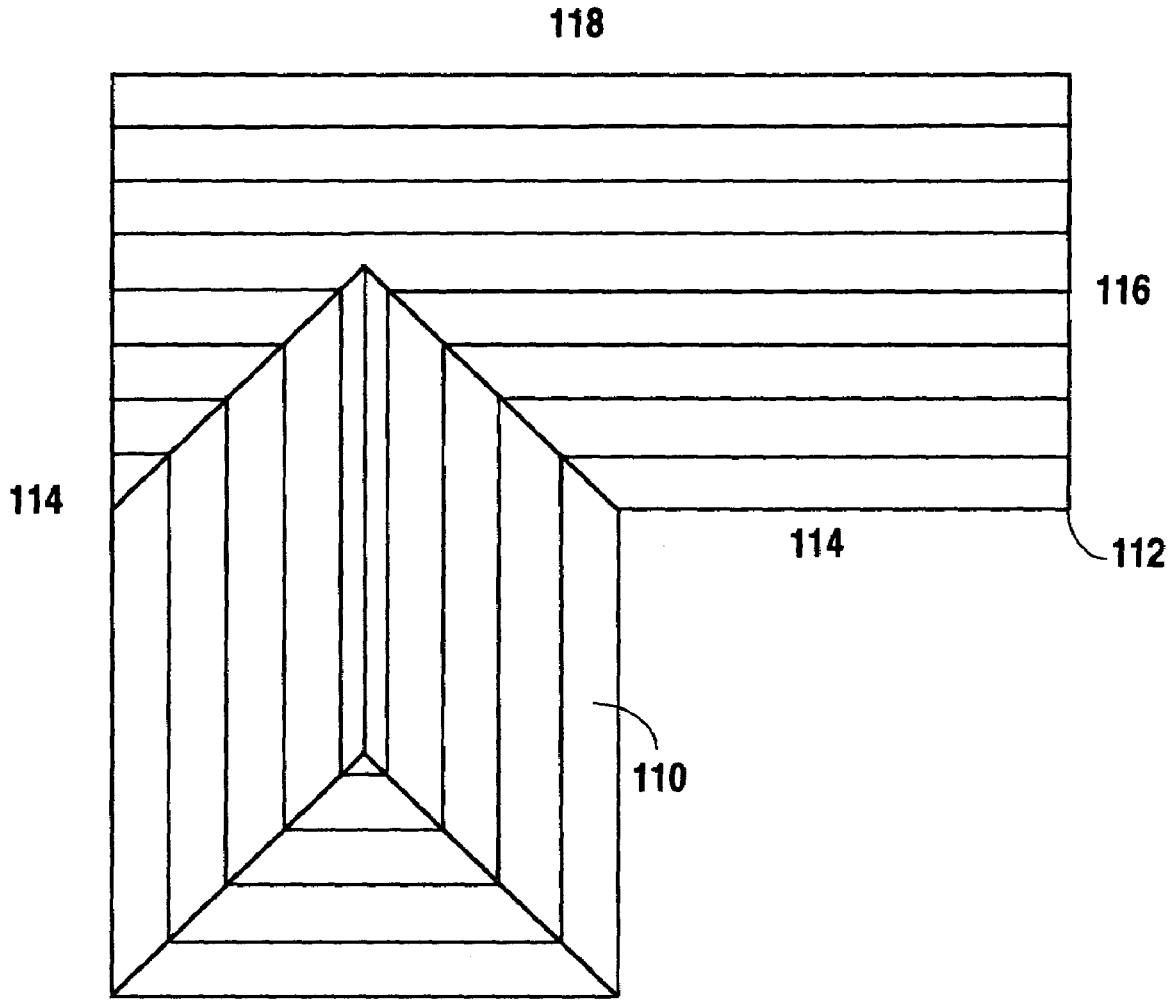
FIG. 3 is a top view of the roof deck illustrating placement of underlayment.

In FIG. 3 a top view of the roof deck 102 illustrating placement of underlayment 110 is shown. In this step of the present methodology, the user installs underlayment 110. The underlayment 110 is preferably a poly(styrene-butadiene-styrene) (SBS) multipurpose or Type 30 per ASTM D226. During this step, the user will roll the underlayment 110 over the gable/rake edge 112 a preferred minimum of one inch. There is a preferred minimum headlap of two inches for the underlayment 110; this is preferably increased to a minimum of four inches in wet or snow areas. Headlap for purposes of this application is defined as the portion of slate 130 (See FIG. 6) overlapped by two Layers of slate 130 (See FIG. 6) from the next two rows. Headlap makes the roof watertight. Failure to adhere to the recommended headlap can lead to interior water damage. There is a preferred minimum six inch sidelap for the underlayment 110. For purposes of this application, sidelap is defined as side edges of adjoining pieces of underlayment. Nails (not shown) are used to secure the underlayment 110 and have a pattern of preferably 12 inches on center at the headlap and preferably 36 inches on center at the center of the underlayment roll.

Figure 4:
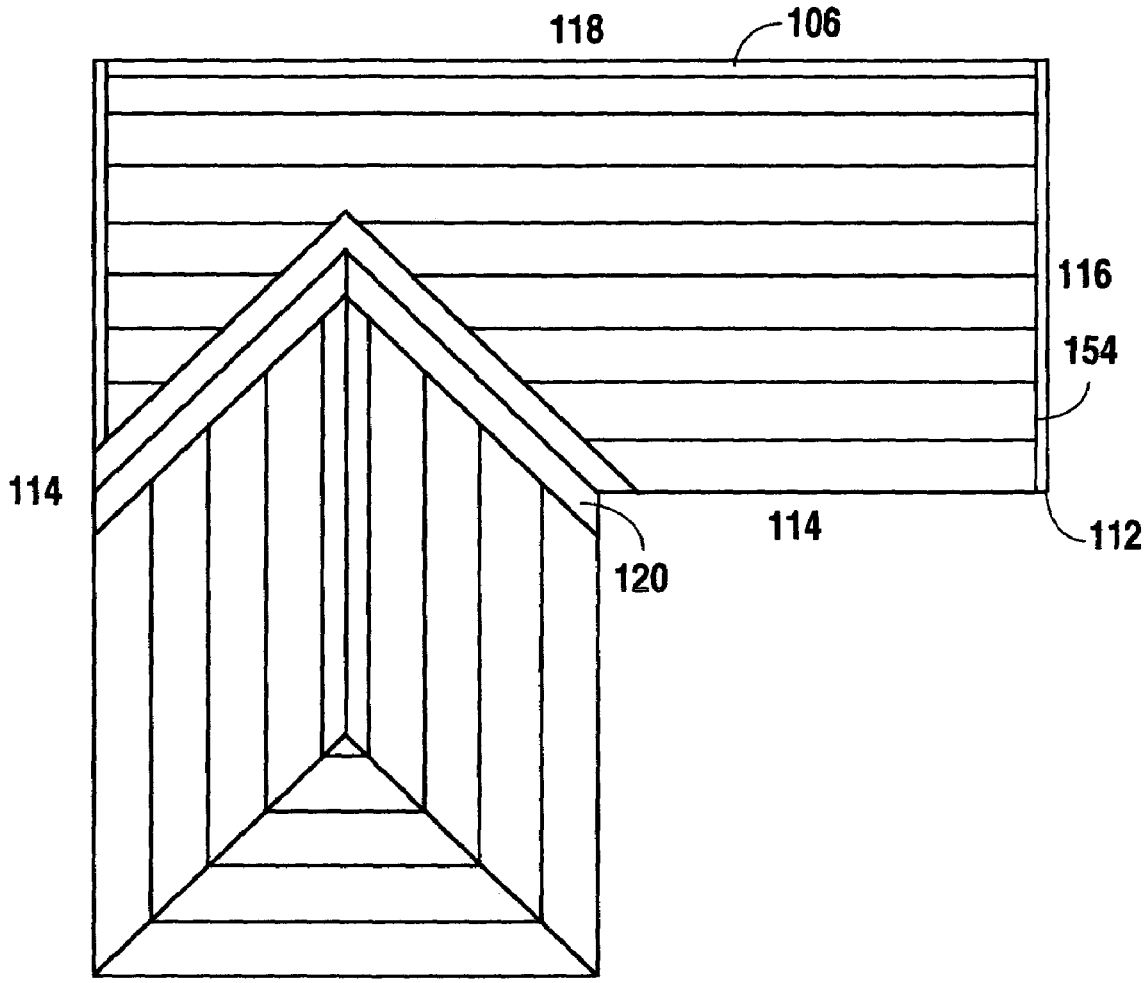
FIG. 4 is a top view of the roof deck illustrating placement of valley metals and rake edge metals.
Figure 16:
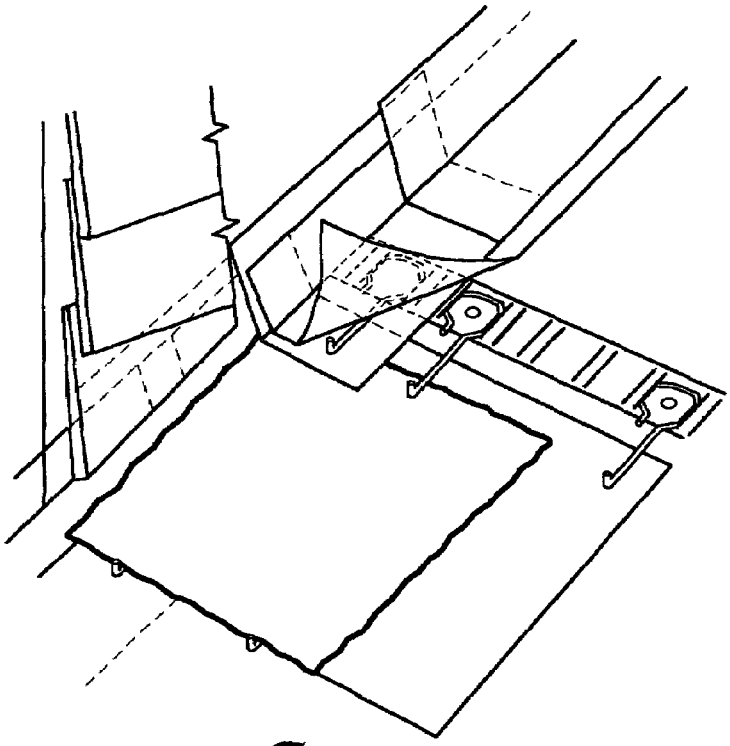
FIG. 16 is a perspective view of the roof deck illustrating flashing at siding.
Figure 17:
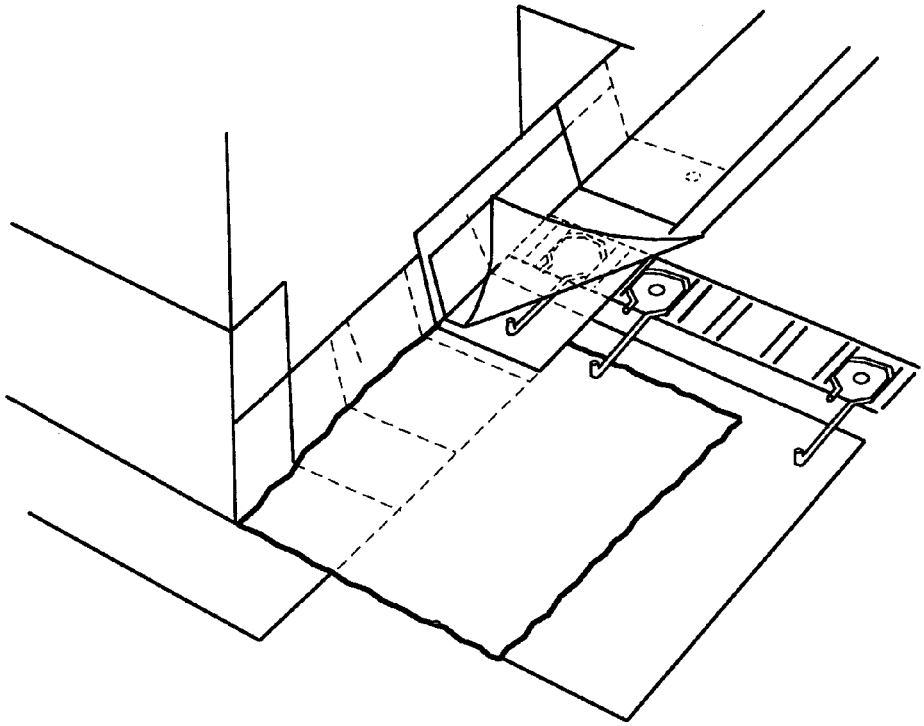
FIG. 17 is a perspective view of the roof deck illustrating flashing at sidewall/chimney.
Figure 18:
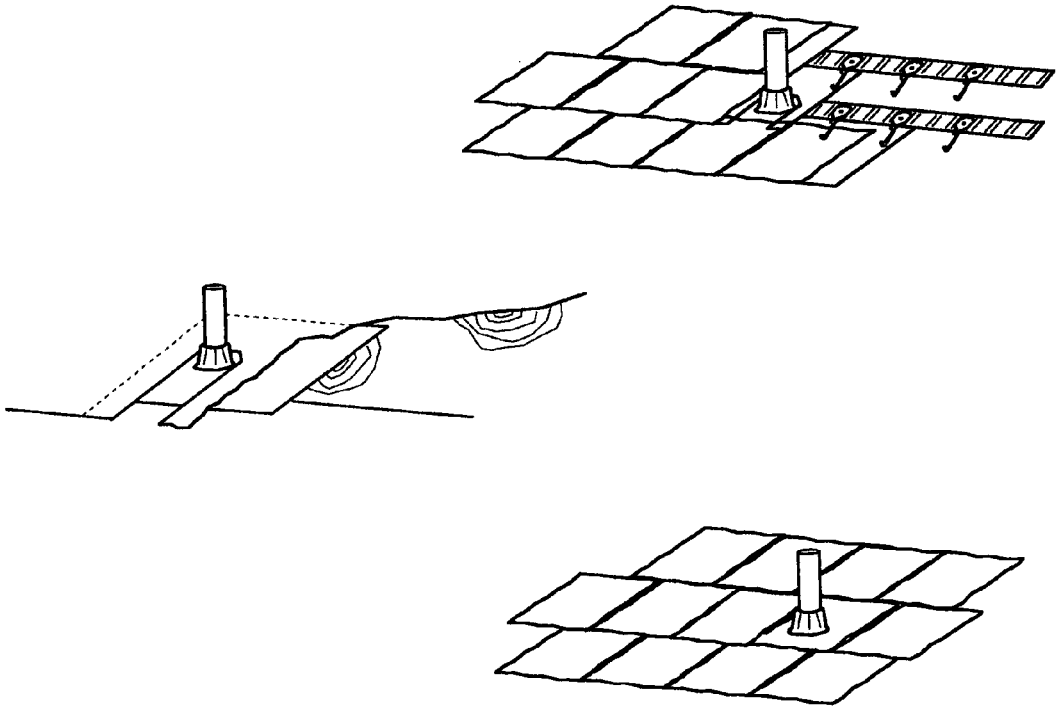
FIG. 18 is a perspective view of the roof deck illustrating plumbing vent details with installation.

FIG. 4 is a top view of the roof deck 102 illustrating placement of valley metals 120 and rake edge metals 154. In the present methodology, the user will install valley metal 120 over membrane 106 (See FIG. 2). This valley metal 120 is preferably 26 gauge galvanized, 24 inch "W", or 16 ounce copper metal. It is preferably installed with a one inch splash diverter (not shown) and preferably fastened with 1.25 inch roof nails or 1.25 inch copper slating nails one inch from the edge. The user will also install gable/rake edge metals 154 at gable/rake edge 112. The gable/rake edge metal 154 is preferably 26 gauge galvanized or 16 ounce copper metal. Next the user will install vertical wall flashings (See FIGS. 16 and 17) and plumbing stack and vent flashings (See FIG. 18). The vertical wall flashings (See FIGS. 16 and 17) are preferably 26 gauge galvanized or 16 ounce copper. At the next step, the user will install peel and stick membrane 106 over ridge 118. The membrane 106 used is preferably a self-adhering poly (styrene-butadiene-styrene) (SBS) type. The membrane 106 is preferably 12 inches wide having three inch endlaps.

Figure 5:
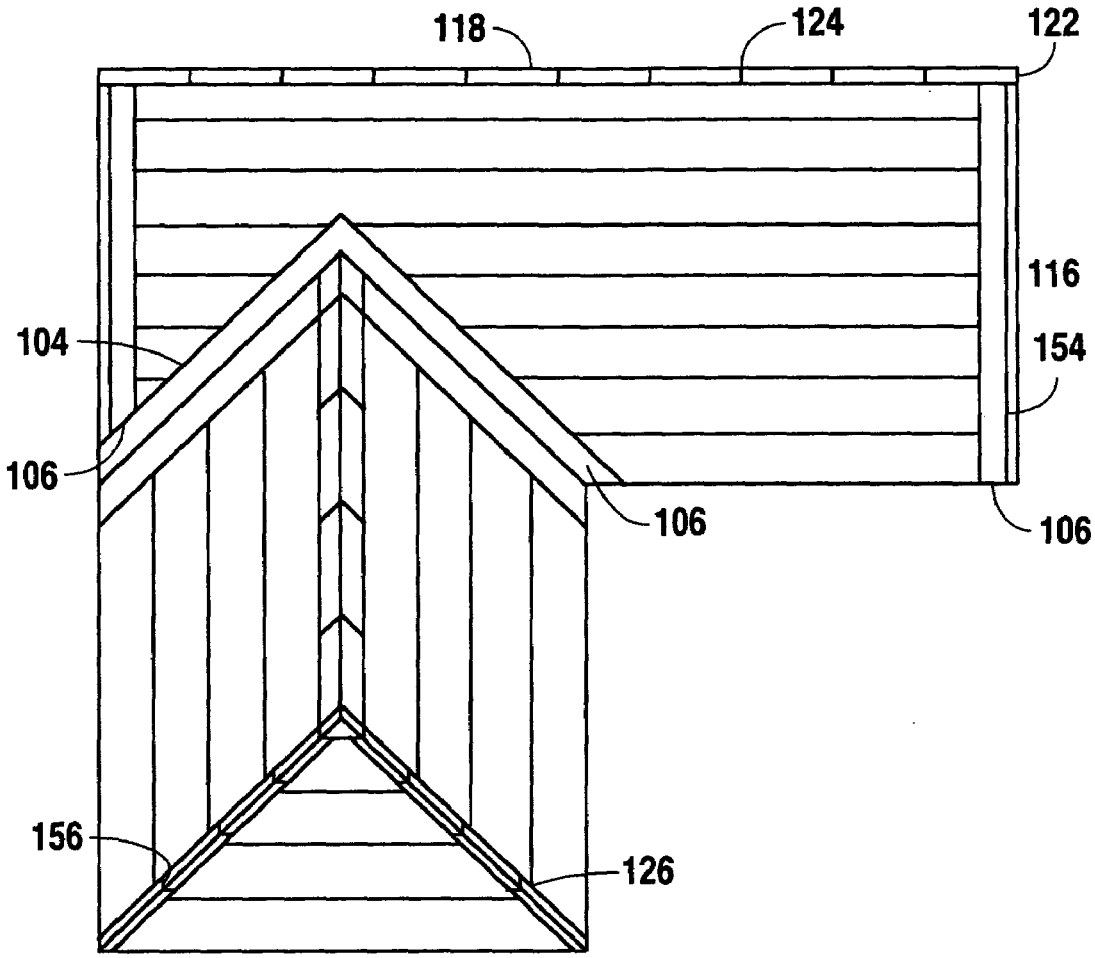
FIG. 5 is a top view of the roof deck illustrating preparation of all valleys, hips, ridges, walls and roof penetrations.

In FIG. 5 a top view of the roof deck 102 illustrating preparation of all valleys 104, hips 156, ridges 118, walls and roof penetrations is shown. Peel and stick membrane 106 is applied over valley metal 120 (See FIG. 4) leaving preferably three inches from the center line of valley 104 uncovered. The membrane 106 should cover valley metal 120 a preferred minimum of 11 inches on each side of the center line and cover nails a preferred minimum of three inches. With a utility knife, the user will cut preferably ten inch wide strips from the roll of peel and stick membrane 106. The user will install peel and stick membrane 106 over the gable/rake edge metal 154 being sure to cover all fasteners. The membrane 106 should extend a preferred minimum of six inches beyond the gable/rake edge metal 154 over the underlayment 110. This gable/rake edge metal 154 membrane 106 will also extend over the valley 104 membrane 106. The membrane 106 on the valley metal 120 and the gable/rake edge metal 154 is self-adhered, not nailed. The membrane 106 should also be installed over all other flashings and roof penetrations a preferred minimum of six inches past all flashings. Next the user will install the hip spacer 126 and the ridge spacer 122 using preferably 1.5 inch roofing nails or coated decking screws. These fasteners are preferably placed at 24 inches on center on each side of the nailer. Spacer flashing 124 is cut from slate liner 140 and placed over the ridge spacer 122 and should preferably overlap 12 inches at sidelaps.

Figure 6:
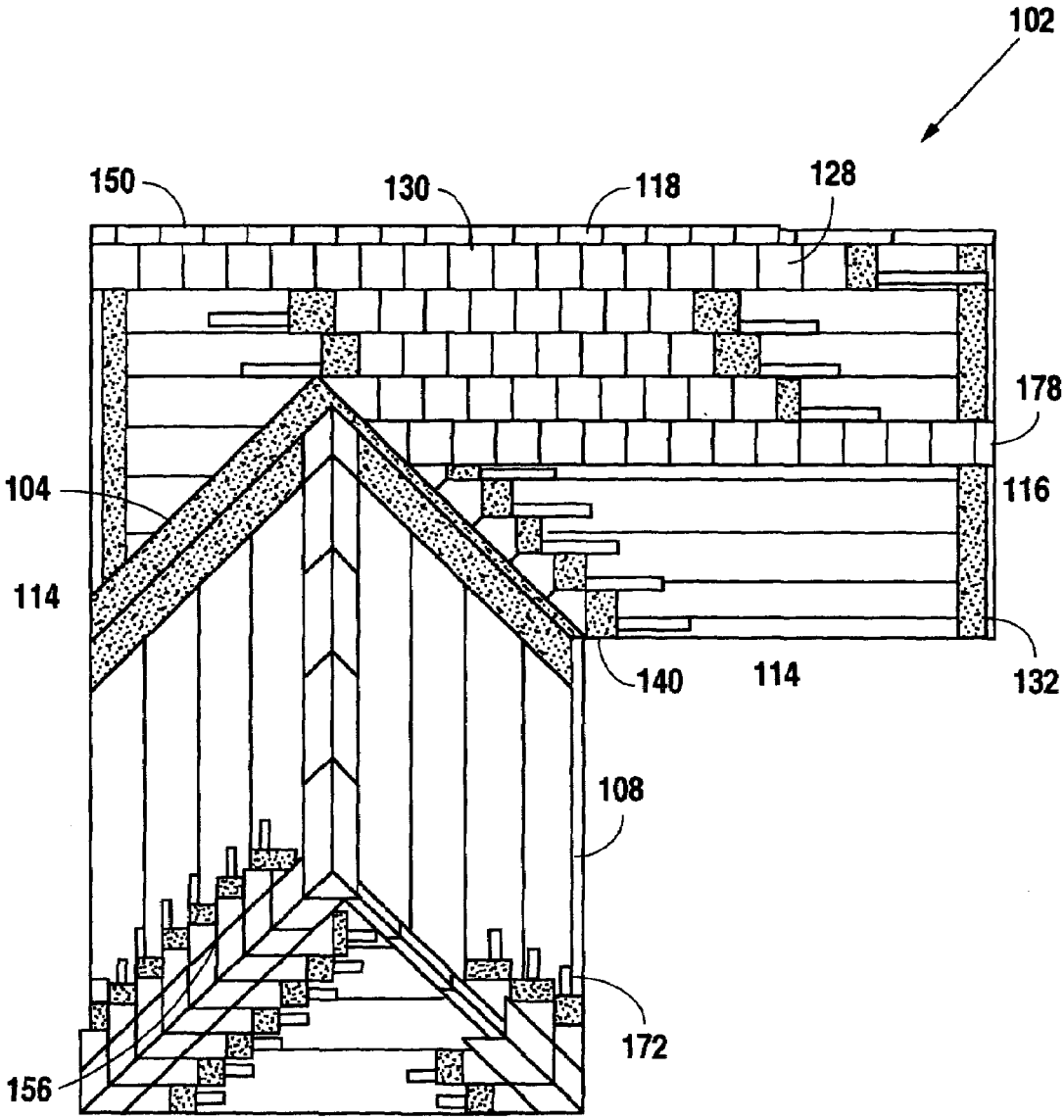
FIG. 6 is a top view of the roof deck illustrating the installation of slate.
Figure 7:
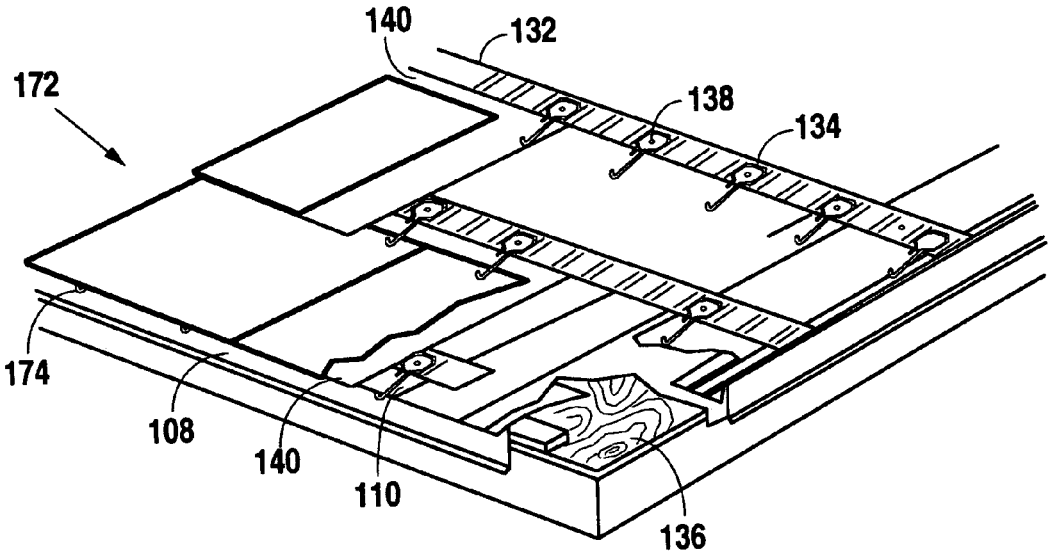
FIG. 7 is a perspective view of the roof deck illustrating installation of slate.
Figure 8:
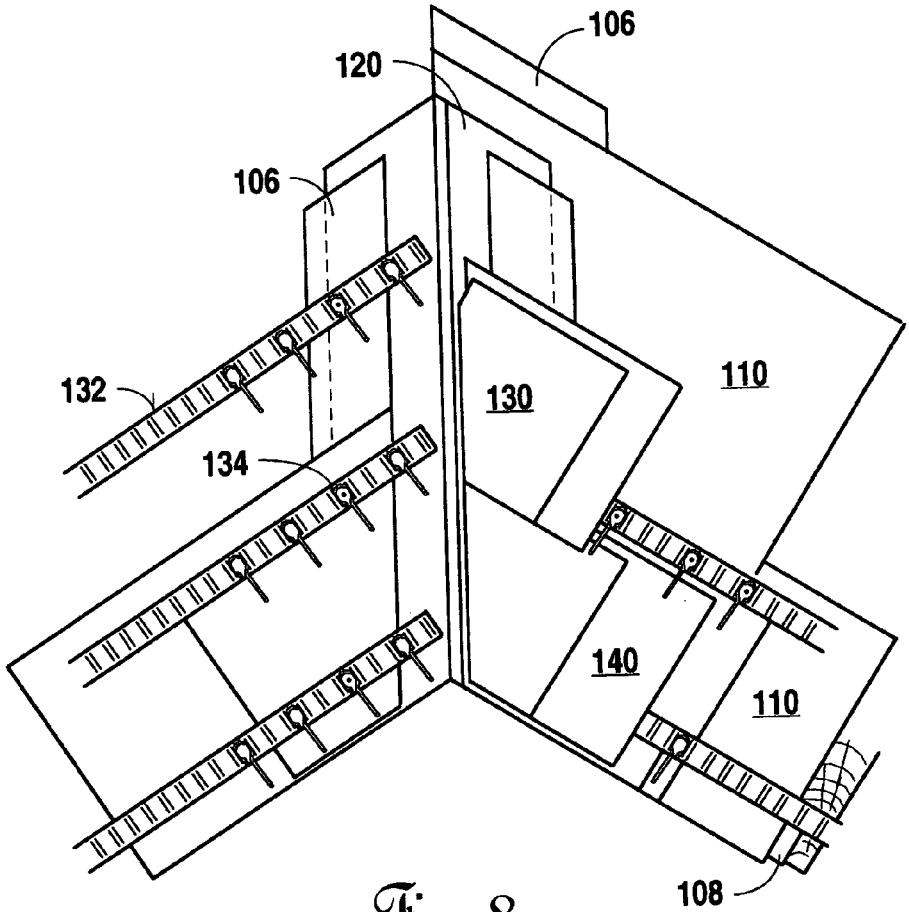
FIG. 8 is a perspective view of the roof deck illustrating slate installation at the valley.

FIG. 6 is a top view of the roof deck 102 illustrating the installation of slate 130. In the slate installation step, the roof deck 102 is outlined with slate 130. The hips 156, ridges 118 and valleys 104 are outlined first. Next the user wilt locate and mark the bottom batten row 172 at the drip edge 108. The bottom row 174 (See FIG. 7) of hangers 134 (See FIG. 7) should extend to the drip edge 108. The user will use a chalk line and measuring tape to locate the remaining rows for battens 132. Battens 132 should be preferably installed at 10 inch intervals. The battens 132 are preferably galvanized or stainless steel. Stainless steel is generally used where coastal salt water corrosion is a concern. Batten 132 spacing may be increased or decreased to accommodate fraction spacing. The user will begin at the hips 156 and valleys 104 and work up the roof deck 102 installing a full batten 132, slate liner 140, and 2-3 slates 130 at each row, leaving the field clear to walk. Next the user will locate and install top row battens 132, slate liner 140, and top row of slates 130 (ridge row 178), then install ridge slates 150. The ridge slates 150 should overlap and lock in the ridge row 178 of slates 130. The user will trim off any exposed slate liner 140 with a utility knife. Beginning four rows down from the ridge row 178 of states 130, the user will install batten 132 on one complete row of slate 130. Hangers 134 are preferably preinstalled on battens 132. The user will lay slate liner 140 on hangers 134 (See FIG. 7) and drop slate 130 onto hangers 134 (See FIG. 7). The hangers 134 (See FIG. 7) are preferably spring tempered stainless steel. The user is cautioned to confirm that the keyways or joints line up with the ridge row 178 of slate 130. Next the user will install the next row of battens 132 locking in the row of slate 130 below and repeating the process. The user offsets the keyways ½ slate 130 every other row. The last row may be "shoehorned" in by the user. The user will come down the roof four rows and repeat the process. A perspective view of this slate installation process is shown in FIG. 7 white FIG. 8 illustrates a perspective view of the slate installation at the valley 104. Greater detail on the slate 130 installation is show in FIGS. 12-15.

Figure 9:
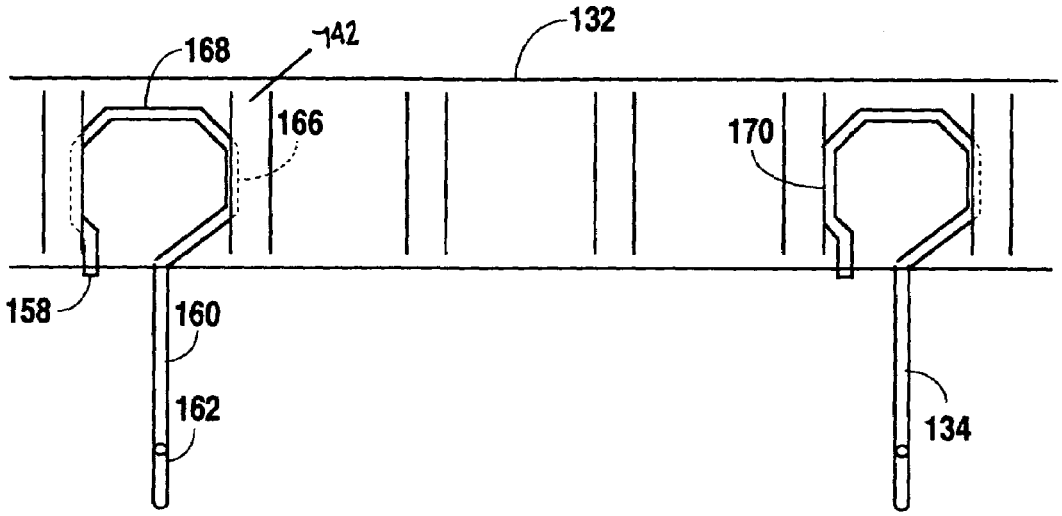
FIG. 9 is a top view of batten with hangers used in the present methodology.
Figure 19:
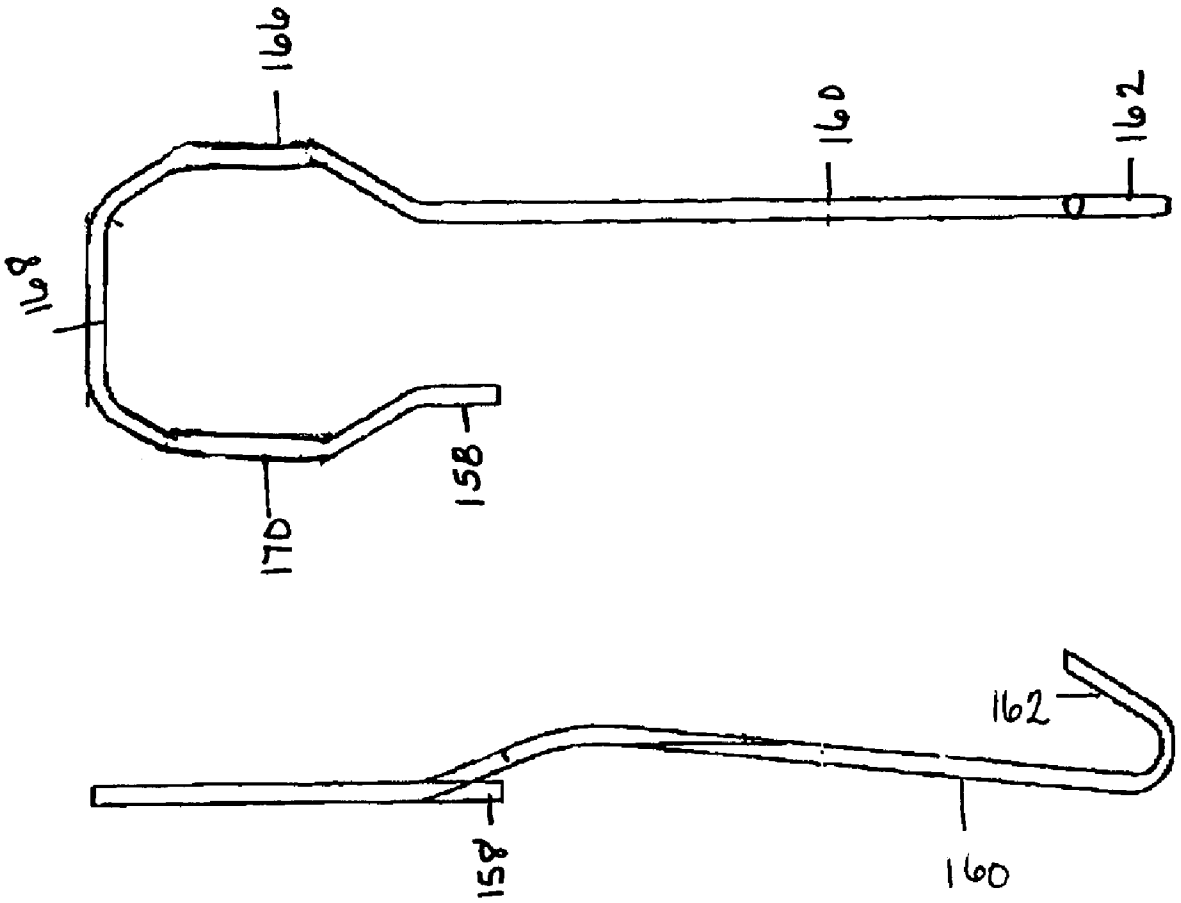
FIG. 19 is a side view of the hanger of the present invention.

In FIG. 9 a top view of batten 132 with hangers 134 used in the present methodology is shown. Hangers 134, which are preferably spring tempered stainless steel, can be easily installed and removed to facilitate proper support for the slate 130. The hangers 134 represent the strength of the present invention and provide a convenient way to quickly and easily install and remove individual slate 130. The hangers 134 have a short member 158 and a long member 160. The long member 160 has an upward facing hook 162 at one end and the remaining end is adjacent to a first outward extending arm 166. The first outward extending arm 166 is adjacent a central connecting member 168. This central connecting member 168 is adjacent a second outward extending arm 170. This second outward extending arm 170 is adjacent the short member 158. While the majority of hanger 134 rests in one plane, long member 160 extends at an angle above the plane of first outward extending arm 166, curves downward at an angle and ends at a point within the linear plane of the first outward extending arm 166. This is illustrated in more detail in FIG. 19. When installing the hanger 134, the user will insert the second outward extending arm 170 of the hanger 134 into an opening formed by a first hanger holder 142. The first outward extending arm 166 of hanger 134 will then be inserted into an opening formed by an adjacent hanger holder 142. When removing the hanger 134, the user squeezes together the short member 158 and Long member 160 to remove the hanger 134 from the first hanger holder 142 and the adjacent hanger holder 142.

Figure 10:
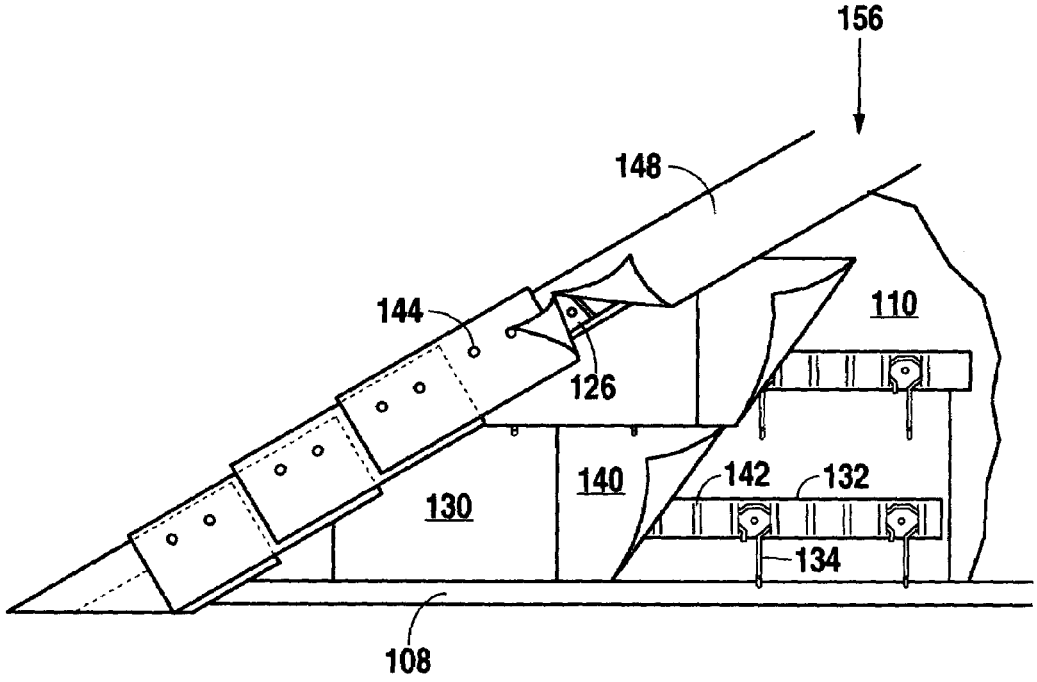
FIG. 10 is a front view of the roof deck illustrating hip installation of slate.

FIG. 10 is a front view of the roof deck 102 illustrating hip 156 installation of state 130. The hips 156 of the roof deck 102 are one of the first areas outlined with state 130. The user will install battens 132 on top of the underlayment 110. Hangers 134 are inserted into hanger holders 142 of battens 132. The user will lay slate liner 140 on hangers 134 and drop slate 130 onto hangers 134. At the hips 156, hip spacer 126 is applied followed by hip spacer cover 148. Slate trim pieces 146 are applied and attached to hip 156 by decking screws 144.

Figure 11:
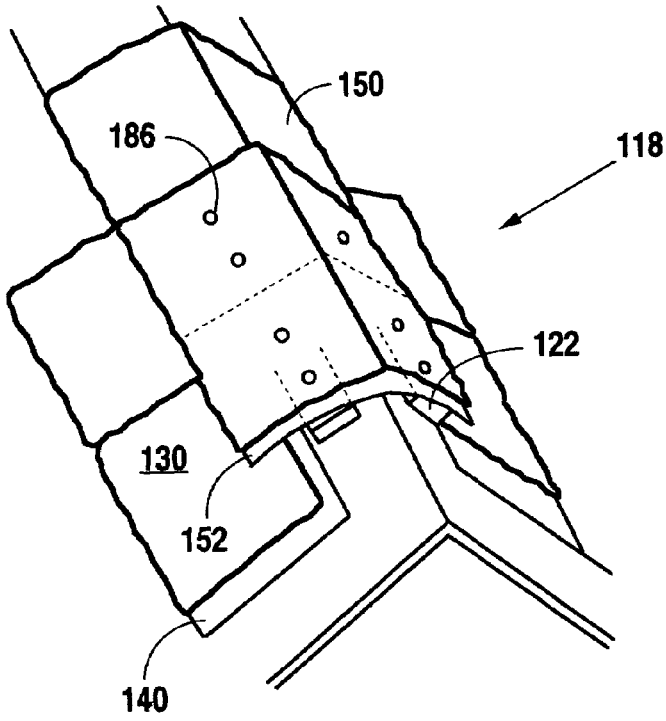
FIG. 11 is a top view of the roof deck illustrating the ridge.
Figure 12:
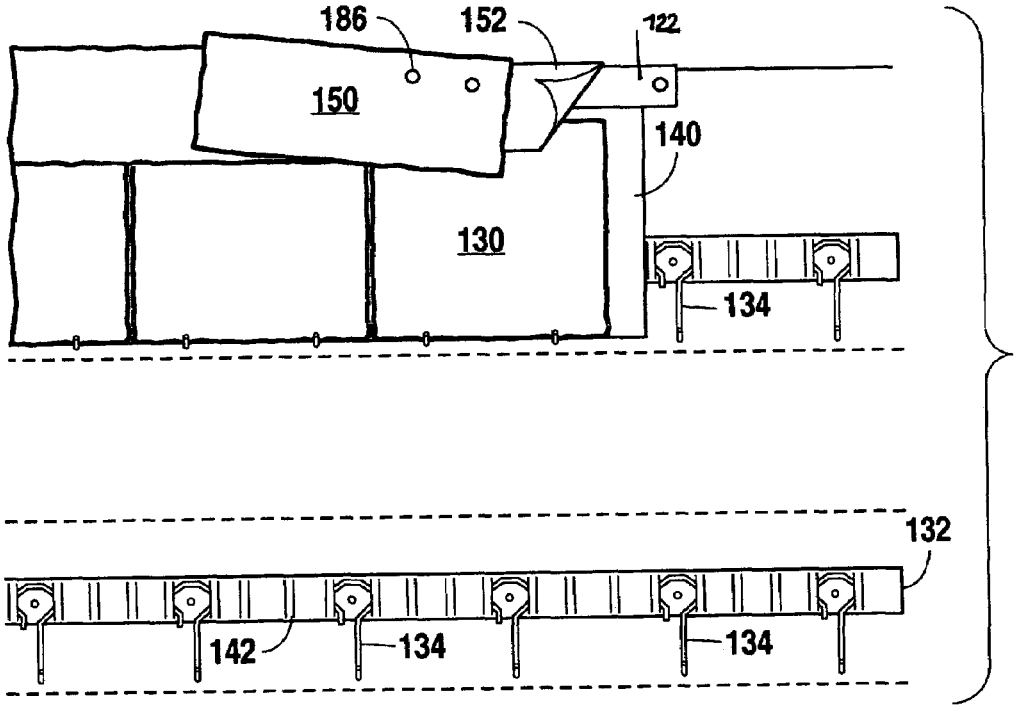
FIG. 12 is a side view of the roof deck illustrating ridge installation of slate.

In FIG. 11 a top view of the roof deck 102 illustrating the ridge 118 installation is shown. With the ridge 118 installation step, the user will install ridge spacers 122 by making sure the ridge spacer 122 is preferably evenly spaced over the ridge 118 and fastened at preferably 24 inches on center along each side of ridge 118 with preferably 1.5 inch roofing nails or screws. The user will place preferably 13 inch wide slate liner 140 over the ridge spacers 122 so that the center line of slate liner 140 is centered along the ridge 118. It is preferred to work with 10-12 foot lengths being sure to preferably overlap end joints 12 inches minimum. Next, the user installs top batten 132 (See FIG. 12) along a chalk line using a nail gun and preferably 1.25 inch 0.120 galvanized standard coil fed roofing nails. Hangers 134 (See FIG. 12) are inserted into hanger holder 142 (See FIG. 12) of battens 132 (See FIG. 12). The batten 132 (See FIG. 12) is fastened at the center of the hanger 134 (See FIG. 12) except at the gable/rake edges 112 (See FIG. 4). The user lays the slate liner 140 along row of hangers 134 (See FIG. 12) and tucks under the plastic ridge spacer cover 152. The ridge spacer cover 152 should preferably overlap top row of slate liner 140 by a minimum of three inches. The user will next lay the first row of slate 130 by placing bottom edge of each slate 130 into top row of hangers 134 (See FIG. 12). The hangers 134 (See FIG. 12) are preferably preinstalled at six inches center. The slates 130 are preferably twelve inches wide by twelve inches long standard quarried slate. The user must be careful that the hangers 134 (See FIG. 12) are evenly spaced on the slate 130. Each hanger 134 (See FIG. 12) should be preferably three inches from the edge of each full piece of slate 130. On smaller pieces, care should be taken to be sure two hangers 134 (See FIG. 12) are supporting each piece of slate 130. Hanger 134 (See FIG. 12) can be easily removed and replaced to facilitate spacing up to preferably 1.5 inches. The user must never install a piece of slate less than four inches in width. If a measurement calls for a piece of slate 130 less than four inches wide, the adjacent piece should be cut back so that the small piece is preferably a minimum of four inches. The cut edges can be placed side by side so that the cut edge disappears and is not distinguishable. The user must be sure the ridge spacer cover 152 overlaps the top row of slate 130 a preferred minimum of two inches. The top edge of the top row of slate 130 should be no more than preferably one inch from the bottom of the ridge spacer 122. The ridge trim pieces 150 are installed by nailing or screwing each piece of state 130 through two predrilled holes 186 directly through the ridge spacer 122 into the roof deck 102. The trim pieces 150 are preferably 16 inch×7 inch standard quarried slate predrilled. The edge of each trim piece 150 must meet at the top of the ridge 118 and one piece should slightly overlap the other so that a clean, weather resistant joint is formed. If desired, the user may apply a weatherproof caulk of a matching color to the joint. The caulk is preferably a high quality exterior grade silicone. Next, the next ridge trim piece 150 is installed by overlapping the previously installed piece by preferably six inches. If desired, each nail hole can be covered with a weatherproof caulk. The ridge trim pieces 150 should overlap the top of the first row of state 130 by a preferred minimum of two inches. Care should be taken not to overdrive the fasteners on ridge trim pieces 150. The slates 130 should be able to wiggle slightly. Any plastic ridge spacer cover 152 that is visible after the ridge trim pieces 150 are installed can be carefully trimmed with a utility knife. FIG. 12 is a side view of the roof deck 102 illustrating ridge 118 installation of slate 130.

Figure 13:
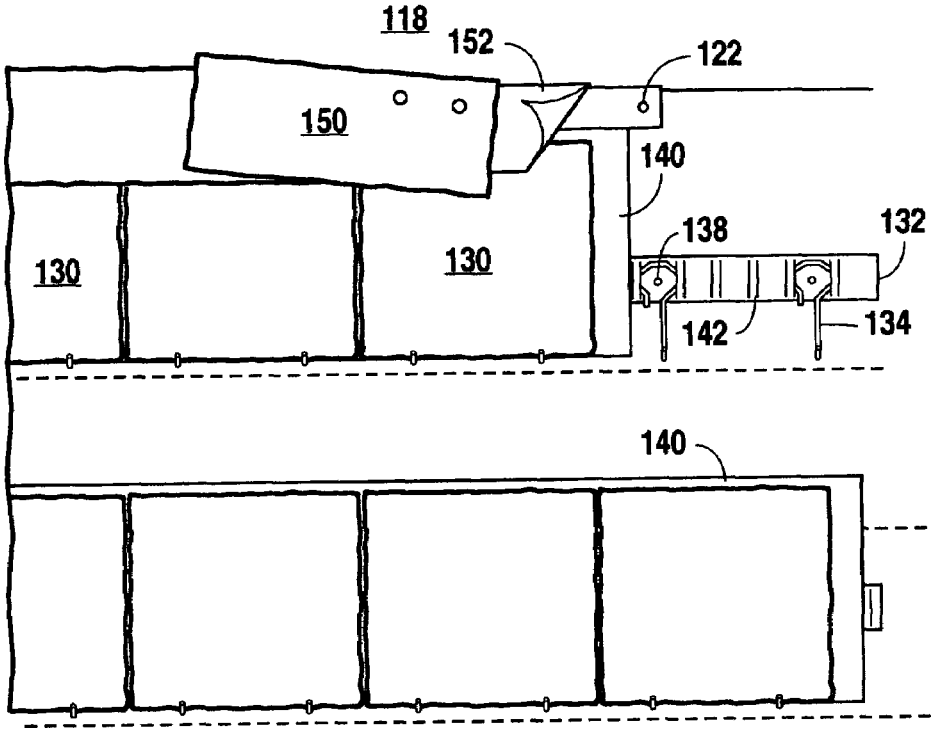
FIG. 13 is a detailed view of slate installation step 1.

In FIG. 13 a detailed view of slate 130 installation step 1 is shown. In installation step 1, the user installs battens 132 end to end on a fourth chalk line from the top or ridge 118. The user fastens each batten 132 with roofing nails 138 at the center of each hanger 134 approximately every six inches. The slate liner 140 is next installed by placing it along the row of battens 132 using the hangers 134 to support the slate liner 140. It is recommended that each piece of slate liner 140 be preferably a maximum of 25 feet long. The pieces of slate liner 140 should preferably overlap a minimum of twelve inches at side laps. Slate liner 140 should be installed with the dull finish side up or shiny side down. No nails are driven through the slate liner 140. Next the user installs slates 130 by placing slates 130 on the hangers 134 being careful to keep hangers 134 centered on the slates 130. Each slate 130 should have two hangers 134 supporting it preferably evenly spaced from each side edge of the slate 130. Full states 130 should have a hanger 134 preferably three inches from each side edge. At the beginning or end of each row a one-half slate offset is recommended and can be achieved by placing additional hangers 134 at the hanger holders 142 provided in the battens 132. The battens 132 can be cut with tin snips. The user should align the battens 132 end to end preferably maintaining a six inch space between the hangers 134 for slates 130 (or three empty hanger holders 142 in the battens 132). Battens 132 should be held back ½ inch from ridge spacers 122 or gable/rake edge metals 154 (See FIG. 5).

Figure 14:
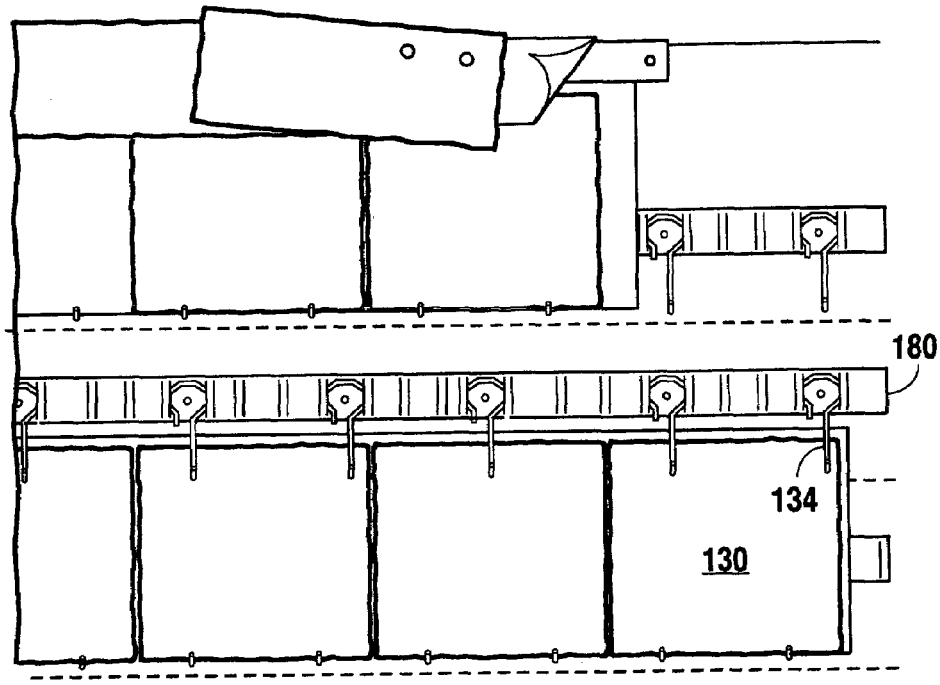
FIG. 14 is a detailed view of state installation step 2.

FIG. 14 is a detailed view of slate 130 installation step 2. In this step of installation, the user will install the next row 180 of battens 132. The battens 132 should lock into the slates 130 below. The user must be sure the hangers 134 are preferably evenly spaced on the states 130 below. The hangers 134 should be preferably three inches from each edge of each slate 130. Tin snips are used to trim the battens 132 at the ends to facilitate hanger 134 spacing.

Figure 15:
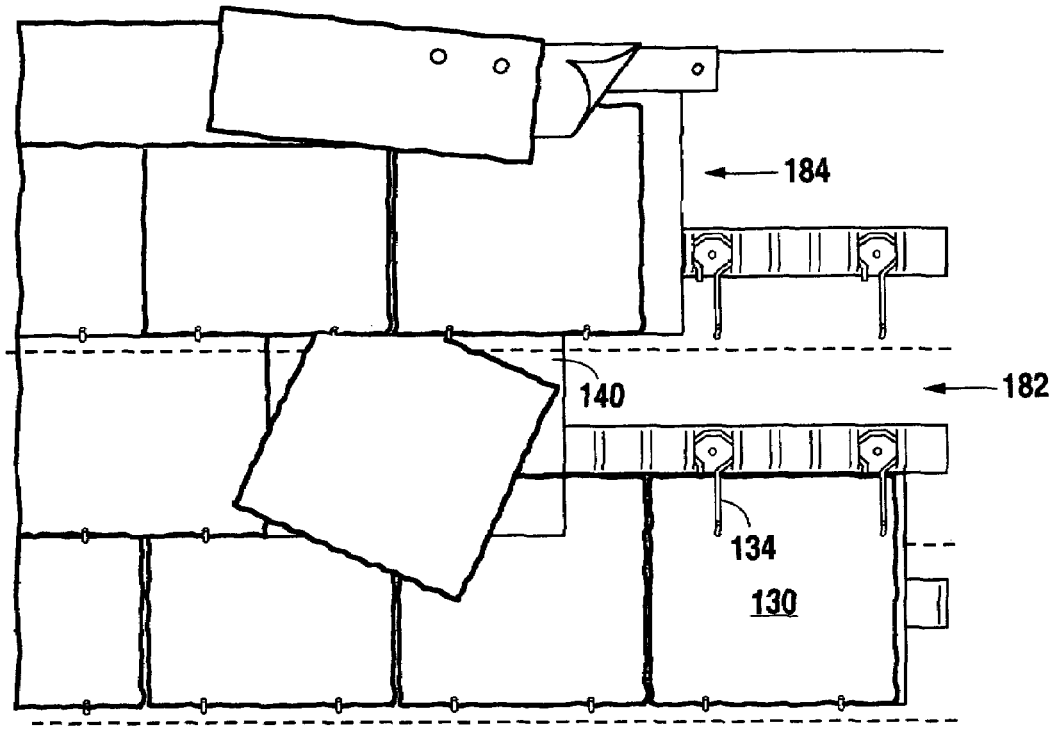
FIG. 15 is a detailed view of state installation step 3.

In FIG. 15 a detailed view of slate 130 installation step 3 is shown. In this step of installation, at the top row of each working section an open row 182 is created. To complete the installation of the open row 182, the user must install slate liner 140 by slipping it under the top row 184 of slate 130. The bottom edge of the slate liner 140 is held in place by hangers 134. Next the user installs the slates 130 by slipping the top edge of the slate 130 under the top row 184 until the bottom edge of the slate 130 clears the hangers 134 below. The user pulls or pushes the slate 130 downward slightly until the hangers 134 support the bottom edge of the slate 130. Preferably an 18 inch wide piece of slate liner 140 can be used as a shoehorn by inserting it first, then the slate 130 slides easier into place. The shoehorn is removed and the process is repeated.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention.

It is, therefore, contemplated that the appended claims will cover such modifications that fall within the scope of the invention.

I claim:

1. A roofing system for covering a roof deck, the system comprising:

a plurality of slate rows, said slate rows being comprised of a plurality of slate members, said slate members having two side edges, a top edge and a bottom edge, wherein said side edges are aligned with the side edges of an adjacent slate member to form said slate row; and said slate members being secured to said roof deck by an attachment subsystem comprising:

a plurality of battens each having a plurality of hanger holders disposed along its length, each of said hanger holder comprising opposing openings formed through each of said batten; and a plurality of hangers, said hangers having;

a short member and a long member, said long member having a hook on its distal end, a first outward extending arm having a distal end coupled to a proximal end of the long member and a proximal end coupled to a central connecting member, a second outward extending arm having a proximal end coupled to the central connecting member and a distal end coupled to a proximal end of the short member; and each of said plurality of hangers being removeably secured to a corresponding said hanger holders in said battens by the first and second outward extending arms of each said hanger expanding within the opposing openings of the corresponding hanger holder.

2. The roofing system of claim 1 further comprising a slate liner positioned above said hangers.

3. The roofing system of claim 2 further comprising an underlayment positioned below said battens.

4. The roofing system of claim 3 further comprising a self-adhering membrane positioned below said underlayment.

5. The roofing system of claim 4 further comprising a valley metal positioned on said roof deck.

6. The roofing system of claim 5 further comprising a gable/rake edge metal positioned on said roof deck.

7. The roofing system of claim 6 further comprising a drip edge metal positioned on said roof deck.

8. A method for installing the roofing system of claim 1, the method comprising:

positioning said plurality of battens onto said roof deck;

attaching said plurality of battens to said roof deck; and compressing each of said plurality of hangers by bringing the first and second outward extending arms towards each other, the central connecting member flexible between an expanded position and a compressed position and resilient to return to the expanded position;

disposing the first and second outward extending arms of each hanger into a pair of corresponding openings defined by corresponding hanger holders;

securing the hangers to the batten by the first and second outward extending arms expanding within the opposing openings to the expanded position.

9. The method for installing the roofing system of claim 8 wherein said securing step further comprises squeezing said short member and said long member together and inserting said first outward extending arm and said second outward extending arm into said batten.

10. The method for installing the roofing system of claim 9 wherein said securing step further comprises inserting said first outward extending arm and said second outward extending arm into adjacent hanger holders on said battens.

11. The method for installing the roofing system of claim 10 further comprising the step of positioning said slate liner above said hangers.

12. The method for installing the roofing system of claim 11 further comprising the step of positioning underlayment below said battens.

13. The method for installing the roofing system of claim 12 further comprising the step of positioning self-adhering membrane below said underlayment.

14. The method for installing the roofing system of claim 13 further comprising the step of inspecting said roof deck before applying said self-adhering membrane.

15. The method for installing the roofing system of claim 14 further comprising the step of attaching valley metal to said roof deck.

16. The method for installing the roofing system of claim 15 further comprising the step of attaching gable/rake edge metal to said roof deck.

17. The method for installing the roofing system of claim 16 further comprising the step of attaching drip edge metal to said roof deck.

* * * * *